US006125923A

United States Patent [19]

Nir

[11] Patent Number: 6,125,923

[45] Date of Patent: Oct. 3, 2000

[54] DEVICE AND METHOD FOR HEAT RECOVERY

[76] Inventor: Ari Nir, 2600 Netherlands Ave. #3004, Riverdale, N.J. 10463

[21] Appl. No.: 08/985,922

[22] Filed: Dec. 5, 1997

[51] Int. Cl.[7] ..... F28B 3/00

[52] U.S. Cl. ..... 165/113

[58] Field of Search ..... 165/113, 114, 165/111

[56] References Cited

U.S. PATENT DOCUMENTS 5,377,489 1/1995 Silvestri, Jr. et al. ..... 165/113

*Primary Examiner*—Henry Bennett
*Assistant Examiner*—Malik N. Drake
*Attorney, Agent, or Firm*—I. Zborovsky

[57] ABSTRACT

In a heat exchange device and method one heat exchange is performed between a fluid which flows through a heat exchange element and a fluid which flows in an internal shell surrounding the heat exchange element, and another heat exchange is performed between the fluid flowing in the internal shell and a fluid flowing in an external tank which surrounds the internal shell, with the first heat exchange performed through the wall of the heat exchange element and a second heat exchange performed through the wall of said internal shell.

2 Claims, 1 Drawing Sheet

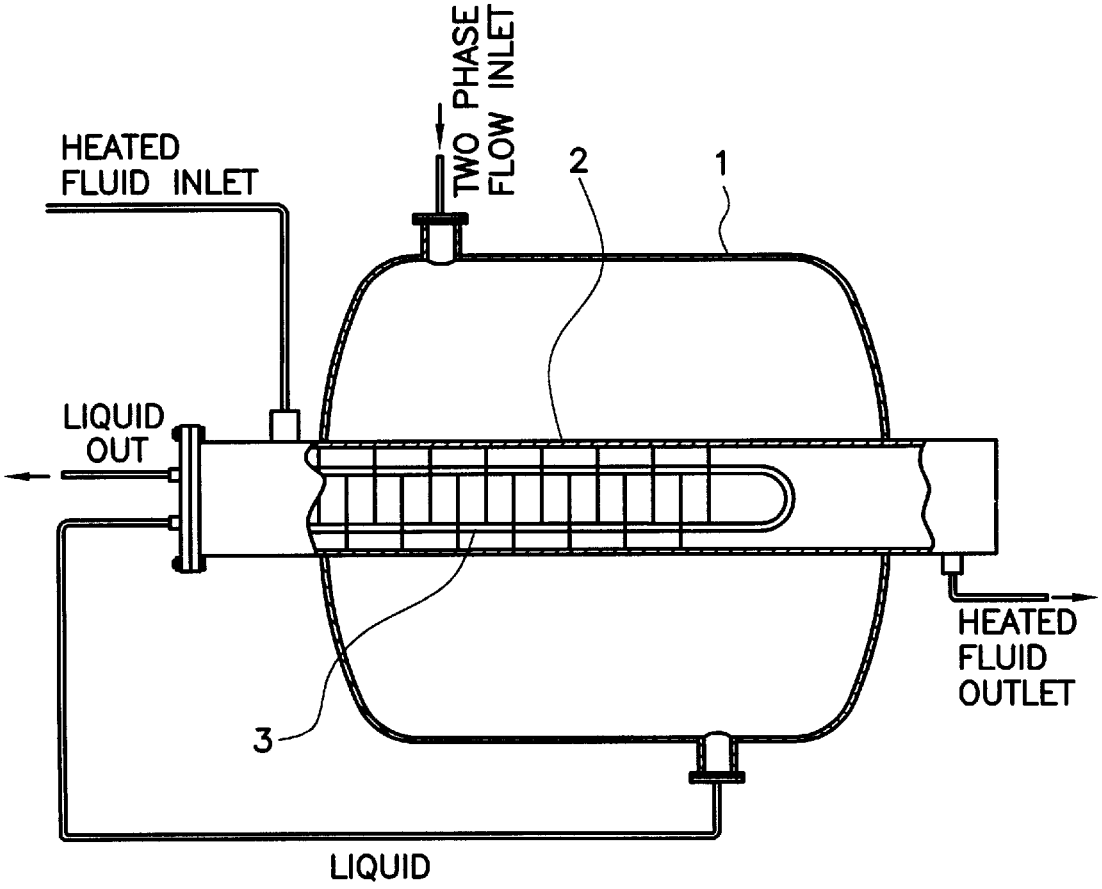
TWO PHASE
FLOW INLET
HEATED
FLUID INLET
2
1
LIQUID
OUT
HEATED
FLUID
OUTLET
3
LIQUID

DEVICE AND METHOD FOR HEAT RECOVERY

BACKGROUND OF THE INVENTION

The present invention relates to devices and methods for heat recovery.

Heat recovery devices and methods are widely known and utilized. Usually, the heat recovery systems include a plurality of fluid-guiding elements which are arranged relative to one another so as to provide a heat transfer from one fluid to another fluid. It is believed that the existing devices and methods can be further improved.

SUMMARY OF THE INVENTION

Accordingly, it is an object of present invention to provide a device and a method of heat recovery which is a further improvement of the existing devices.

In keeping with these objects and with others which will become apparent hereinafter, one feature of present invention resides, briefly stated, in a heat recovery device which has an external tank which limits an external chamber, a shell arranged in said external chamber and limiting an internal chamber, and a heat exchange element arranged in said internal chamber of said shell, so that a heat exchange is performed between a fluid which flows in said heat exchange element and another fluid which flows in said shell through a wall of said heat exchange element, and a further heat exchange is performed between the fluid which flows in said inner chamber of said shell and a further fluid which flows in said external chamber of said external tank through the wall of said shell.

In accordance with the inventive method, the heat exchange is performed in the above mentioned device so that first heat exchange is performed between the fluid flowing inside the heat exchange element and the fluid flowing inside the shell through the wall of the heat exchange element, and another heat exchange is performed between the fluid flowing inside the shell and the fluid flowing in the external chamber of said external tank through the wall of the shell.

When the device is designed and the method is performed in accordance with the present invention, the heat exchange is substantially intensified.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The single FIGURE of the drawing is a view illustrating a device and a method of heat recovery in accordance with present invention.

DESCRIPTION OF PREFERRED EMBODIMENTS

A device for heat recovery in accordance with present invention has an external tank which is identified with reference numeral 1 and limits an external chamber inside said tank. An internal shell 2 is arranged in the external shell 1 and limits an internal chamber inside the shell 2. A tube bundle 3 is arranged in the interior of the shell 2 or in other words in the inner chamber of the shell 2.

The heat recovery device in accordance with present invention operates in accordance with the inventive method which is exemplified by the fluids explained hereinbelow. A mixture of liquid and vapor fractions enters the external tank 1 through a two-phase flow inlet. A fluid to be heated enters the shell 2 through a fluid inlet, passes through the internal chamber of the shell 2 and is withdrawn from an outlet for the fluid to be heated. Due to the temperature difference between the vapor fraction and the external wall of the internal shell 2, the vapor is condensed on the external surface on the wall of the internal shell 2. The condensate drops to the bottom of the external tank 1, where it is mixed with the liquid fraction. The liquid mixture then is introduced into the tubes of the tube bundle 3 and transfers its heat to the fluid to be heated. Then the cooled liquid is withdrawn from the outlet of the tube bundle.

In the device in accordance with present invention, both the tube bundle 3 and the internal shell 2 serve as heat transfer surfaces, when the internal shell transfers the heat of condensation of vapor fraction and the tube bundle transfers heat from the mixture of liquid fraction and condensate.

It will be understood that each of the elements described above, or two or more together, may also find a useful application in other types of constructions and methods differing from the types described above.

While the invention has been illustrated and described as embodied in device and method for heat recovery, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A heat recovery device, comprising an external tank limiting an external chamber and having a tank inlet for introducing a two-phase fluid including a liquid and a vapor and also having a tank outlet; an internal shell arranged in said external chamber of said external tank and limiting an internal shell chamber, said internal shell also having a shell inlet and a shell outlet for introducing a fluid to be heated into said internal chamber of said internal shell and withdrawing the heated fluid from said internal chamber of said internal shell; and a heat exchange element located in said internal chamber of said internal shell and having a further inlet communicating with said tank outlet and also having a further outlet, so that when the liquid and vapor are introduced into said external chamber of said external tank the vapor is separated from the liquid and is condensed on a wall of said internal shell, heats said the external wall of said internal shell and a condensate drops to a bottom of said external tank where it is mixed with the liquid to form a mixture, and thereafter the mixture is withdrawn through said tank outlet into an inner space of said tubes of said heat exchange element and heats a wall of said heat exchange element, whereby from the fluid to be heated which flows in said internal chamber of said internal shell is heated from inside by the wall of said heat exchange element by a mixture of the liquids and from outside from the wall of said internal shell by the condensing vapor.

2. A heat recovery device, comprising an external tank limiting an external chamber with an axis and having a tank inlet for introducing a two-phase fluid including a liquid and a vapor and also having a tank outlet; an internal shell arranged radially in said external chamber of said external tank and limiting an internal shell chamber, said internal shell also having a shell inlet and a shell outlet for introducing a fluid to be heated into said internal chamber of said internal shell and withdrawing the heated fluid from said internal chamber of said internal shell; and a heat exchange element located radially in said internal chamber of said internal shell and having a further inlet communicating with said tank outlet and also having a further outlet, so that when the two-phase fluid is introduced into said external chamber of said external tank the vapor is separated from the two-phase fluid and is condensed on a wall of said internal shell, heats said the external wall of said internal shell and a condensate drops to a bottom of said external tank where it is mixed with the liquid to form a mixture, and thereafter the mixture is withdrawn through said tank outlet into tubes of said heat exchange element and heats a wall of said heat exchange element, whereby the fluid to be heated which flows in said internal chamber of said internal shell is heated from inside from the wall of said heat exchange element by a mixture of the liquids and from outside from the wall of said internal shell by the condensing vapor.

* * * * *